United States Patent [19]

Steigerwald

[11] 3,996,643

[45] Dec. 14, 1976

[54] ROLLER WHEEL ASSEMBLY FOR SLIDING CLOSURE

[76] Inventor: Joseph F. Steigerwald, 3240 E. 59th St., Long Beach, Calif. 90805

[22] Filed: Sept. 8, 1975

[21] Appl. No.: 611,445

[52] U.S. Cl. ..... 16/99; 49/425

[51] Int. Cl.[2] ..... E05D 13/02

[58] Field of Search ..... 16/97, 99, 100, 105; 49/425, 427, 420

[56] References Cited

UNITED STATES PATENTS

| | | | |
|---|---|---|---|
| 215,993 | 5/1879 | Townsend | 16/99 |
| 3,040,391 | 6/1962 | Saunders | 16/99 X |
| 3,167,112 | 1/1965 | Tucker | 49/425 |
| 3,175,255 | 3/1965 | Saunders | 49/425 |
| 3,237,238 | 3/1966 | Anderson | 16/105 |
| 3,283,444 | 11/1966 | Andres | 16/99 X |
| 3,879,893 | 4/1975 | Helmick | 16/99 X |

*Primary Examiner*—Werner H. Schroeder
*Assistant Examiner*—Moshe I. Cohen
*Attorney, Agent, or Firm*—Edward A. Sokolski

[57] ABSTRACT

A roller wheel assembly for a sliding closure has a wheel unit which is supported in a frame for vertical motion relative thereto when the assembly is installed in the closure. Means in the form of a wedge assembly which engages sloped surface means in the wheel unit are provided to vertically adjust the wheel unit relative to the track. The wedge assembly is adjusted sidewise by means of a screw assembly which is operated from the side of the frame. This causes wedge shaped surfaces of the wedge assembly to ride along the sloped surface means to afford a continuous and precise vertical adjustment of the wheels.

6 Claims, 7 Drawing Figures

FIG. 1
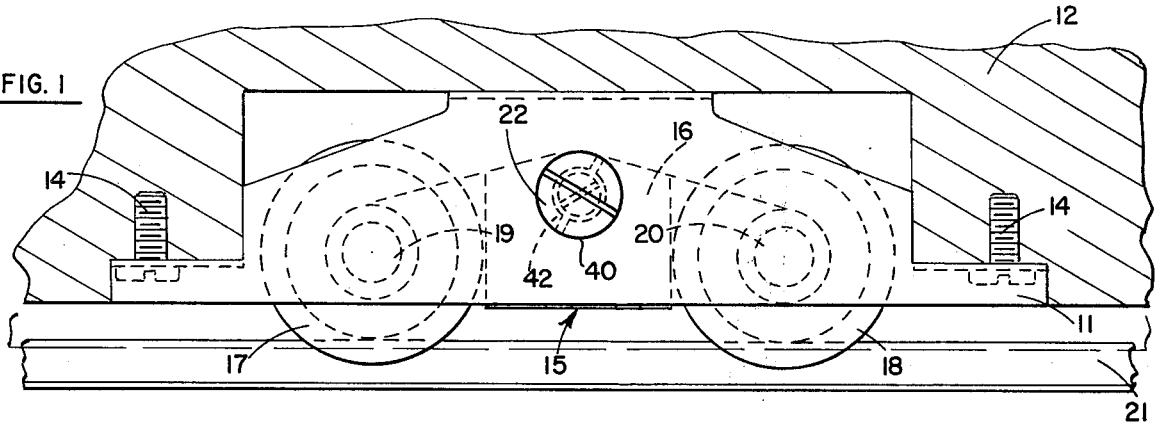
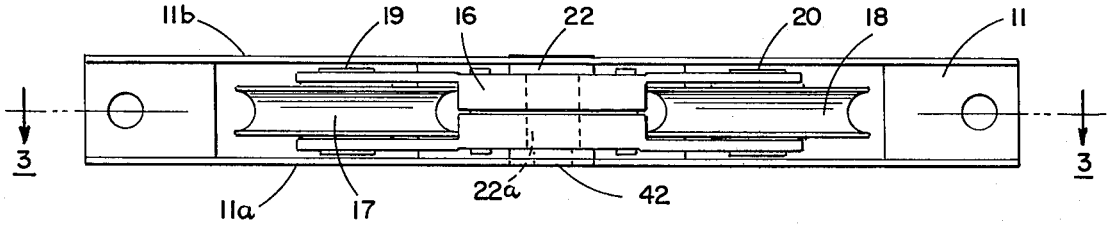
FIG. 2
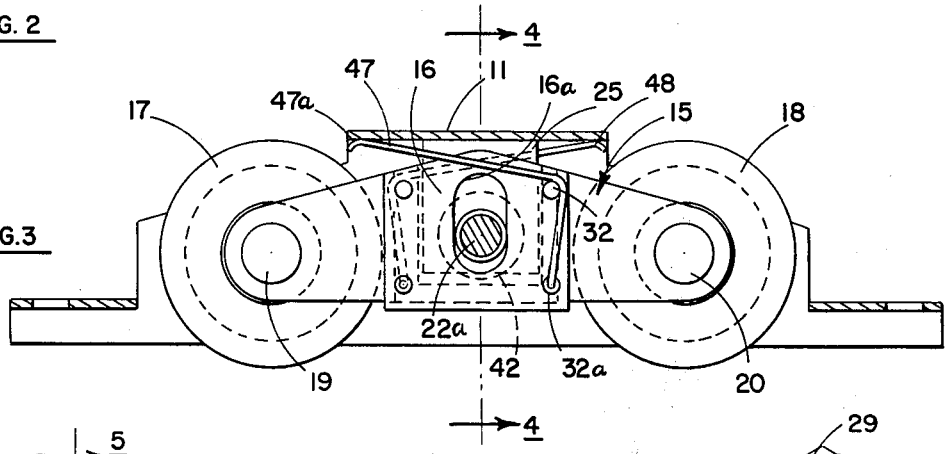
FIG.3
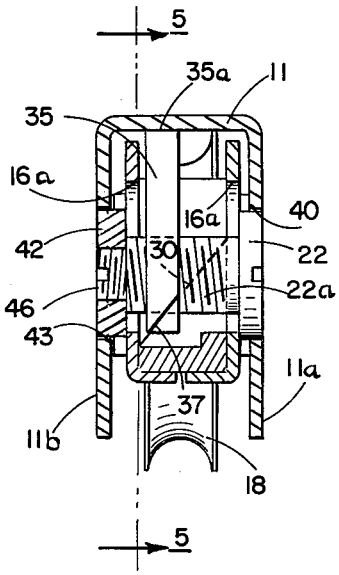
FIG. 4
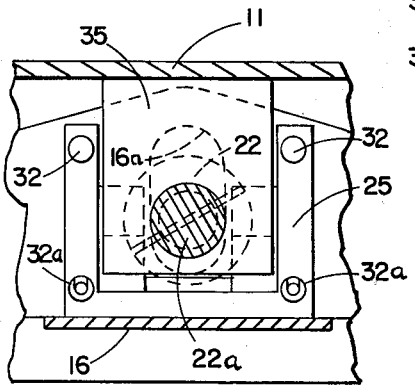
FIG. 5
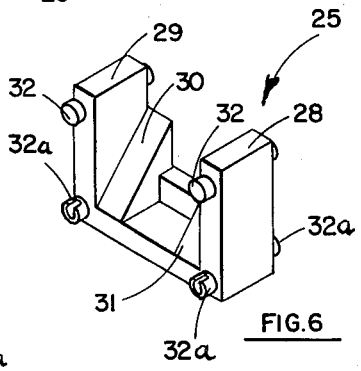
FIG.6
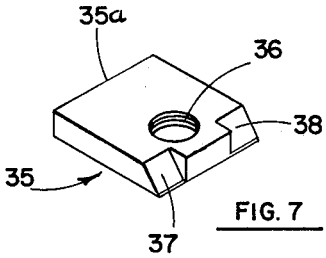
FIG. 7

ROLLER WHEEL ASSEMBLY FOR SLIDING CLOSURE

This invention relates to a roller wheel assembly for sliding closures, and more particularly to such a device which has means incorporated therein for vertically adjusting the position of the wheels while such wheels are bearing the load of the closure.

In roller wheel assemblies for sliding closures, such as sliding glass doors and the like, means are generally provided for vertically adjusting the wheels thereof while the roller assembly is bearing the load of the closure, to properly position the door in its frame. It is highly desirable in devices of this type to locate the adjustment means for the roller assembly in a position which is readily accessible. A particularly convenient position for such adjustment is along the front side of the assembly. A device of this type particularly suitable for use with a dual roller assembly is described in U.S. Pat. No. 3,237,238 issued Mar. 1, 1966. The device of this patent utilizes a cam member having a plurality of notches formed therein which is rotatably positioned to adjust the height of the wheels relative to the casing in a series of discrete steps. This stepped type arrangement has the disadvantage of not affording a continuous adjustment, as would be desired for precise adjustment of the position of the wheel.

The device of the present invention affords an improvement over that of the aforementioned patent and of other prior art devices in providing means for continual and precise adjustment of the vertical position of the wheels while under load. Further, the preferred embodiment of the device of the present invention provides means for resiliently urging the wheels towards the track on which they ride so as to lessen the tendency of the wheels to jump off the track while the closure is being opened or closed.

It is therefore an object of this invention to enable the continuous vertical adjustment of a roller assembly for a sliding closure under load conditions.

It is a further object of this invention to provide a roller assembly for a sliding closure which can be more precisely and smoothly adjusted vertically.

Other objects of the invention will become apparent as the description proceeds in connection with the accompanying drawings, of which:

FIG. 1 is an elevational view illustrating a preferred embodiment of the invention installed in its operative environment;

FIG. 2 is a bottom plan view of the preferred embodiment;

FIG. 3 is a cross sectional view taken along the plane indicated by 3—3 in FIG. 2;

FIG. 4 is a cross sectional view taken along the plane indicated by 4—4 in FIG. 3;

FIG. 5 is a cross sectional view taken along the plane indicated by 5—5 in FIG. 4;

FIG. 6 is a perspective view of the inclined surface assembly used to implement the vertical adjustment in the preferred embodiment; and FIG. 7 is a perspective view of the vertical adjustment wedge assembly of the preferred embodiment.

Briefly described, the device of the invention is as follows: A main frame which is attached to a sliding closure is formed with a pair of side walls between which a wheel unit is mounted. The wheel unit in the preferred embodiment includes a pair of spaced wheels arranged in tandem which are rotatably mounted in a support frame. The wheel support frame has means thereon with one or more similar sloped or inclined surfaces. The wheel support frame is supported in the main frame for vertical motion relative thereto by means of a wedge assembly which is supported in the main frame for adjustable sidewise motion relative thereto. Means are provided to adjust the wedge assembly in a sidewise direction without vertical motion relative to the frame assembly so that it drives against the inclined surface of the wheel support frame, thereby vertically positioning the wheel unit. Spring means are provided in the preferred embodiment to resiliently urge the wheels towards the track, such that they tend to remain seated in the track with opening and closing of the closure.

Referring now to FIG. 1, a preferred embodiment of the invention is illustrated in its installed position. Main frame assembly 11 is fixedly attached to sliding closure 12 by means of screws 14. Wheel unit 15 is mounted between the opposing side walls 11*a* and 11*b* of the main frame by means of screw 22 and nut 42 (see FIGS. 2 and 4), and includes a support frame 16 on which a pair of wheels 17 and 18 arranged in tandem are rotatably supported by means of axles 19 and 20. The wheels ride on track 21 and are adjusted vertically by means of adjustment screw 22. Rotation of screw 22 in one direction will move the wheel unit toward the track, while rotation in the opposite direction will move the wheel unit away from the track. This adjustment is achieved by the cooperative action of the wedge assembly 35, best shown in FIG. 7, and the inclined surface assembly 25, best shown in FIG. 6, as now to be described in connection with FIGS. 2–6. Inclined surface assembly 25 has a pair of opposing wall portions 28 and 29 between which are a pair of inclined surfaces 30 and 31. Assembly 25 is fixedly attached to the central portion of the wheel support frame 16 by means of pins 32 which fit through apertures formed in the walls of the support frame and are staked thereto. Inclined surface assembly 25 may alternatively be integrally formed with wheel assembly 15. The inclined surfaces 30 and 31 run crosswise of the wheel assembly.

Wedge assembly 35, as best seen in FIGS. 4 and 7, has an apertured threaded portion 36 and a pair of wedge shaped surfaces 37 and 38 which in the installed position ride against inclined surfaces 31 and 30 respectively. Threaded shaft portion 22*a* of screw 22 threadably engages the walls of aperture 36. As can best be seen in FIG. 4, the head of screw 22 is located in aperture 40 which is formed in wall 11*a* of frame 11. Screw 22 is retained on frame 11 by means of nut 42 which threadably engages undercut end portion 46 of the screw which has a left handed thread. Alternatively, the screw 22 may be retained by a press fitted rivet. Nut 42 rides on wall 11*b* in aperture 43. The central portion of wheel support frame 16 has a pair of oppositely positioned vertical slots 16*a* formed in the opposite walls thereof to permit vertical motion of screw 22 relative thereto.

The upper surface 35*a* of wedge assembly 35 rides against the inner wall of frame 11 and is constrained thereagainst from vertical motion, such that when screw 22 is rotated, the wedge assembly 35 moves sidewise and cams against surfaces 30 and 31 so as to drive the wheel unit downwardly with sidewise motion of the wedge assembly to the right as viewed in FIG. 4. This sidewise motion as can be seen will cause the wheel unit to be driven downwardly towards the track.

Conversely, rotation of screw 22 in an opposite direction will cause the wheel unit to move away from the track. In this manner, continuous and smooth adjustment of the position of the wheel unit is afforded in simple and effective manner.

A pair of pin type springs 47 and 48 are provided to resiliently urge the wheel assembly towards the track when the load of the closure is temporarily removed therefrom, as for example, should the closure inadvertently jump upwardly off the track while being moved. One of the ends of each of these springs is fitted into a respective aperture 32*a* in the posts of the inclined surface assembly 25, the central portion of the spring being wrapped around an associated one of the upper posts 32 of this assembly, with the opposite end portion 47*a* of the springs abutting against upper inner wall of main frame 11. These springs resiliently urge the wheels towards the track in the event of bouncing motion as the closure is being moved, and tend to prevent the wheels from jumping off the track in such an event.

The device of this invention thus provides a simple yet highly effective means for vertically adjusting the wheels of a sliding closure wheel assembly with a continuous smooth adjustment being provided over the entire adjustment range.

While the invention is described and illustrated in detail, it is to be clearly understood that this is to be taken by way of illustration and example only and is not to be taken by way of limitation, the spirit and scope of this invention being limited only by the terms of the following claims.

I claim:

1. A roller wheel assembly for use in supporting a slidable closure for motion along a track comprising:

a main frame attached to said closure, said frame having a pair of oppositely positioned side walls which are spaced from each other, a wheel unit comprising wheel means and a support frame for rotatably supporting said wheel means, said wheel means riding on said track, means for supporting said wheel unit on said main frame between the side walls thereof, and means for continually adjusting the position of said wheel unit relative to said main frame, thereby to raise and lower the closure relative to the track, comprising inclined surface means fixedly attached to the wheel unit support frame having at least one inclined surface the inclination of which runs in a direction substantially transverse to the direction in which the track extends, a wedge assembly having at least one wedge surface which rides on said inclined surface and means for adjusting the position of said wedge assembly along an axis substantially transverse to the direction in which the track extends, whereby said wedge assembly drives against said inclined surface to effect motion of said wheel unit towards and away from said track.

2. The assembly of claim 1 wherein said wedge assembly has a threaded aperture formed therein and said means for adjusting the position of said wedge assembly comprises a screw which threadably engages the apertured portion of the wedge assembly.

3. The assembly of claim 2 wherein the opposite side walls of said main frame have apertures formed therein in which opposite end portions of said screw fit.

4. The assembly of claim 3 wherein said main frame has a top wall joining the side walls together, the end portion of the wedge assembly opposite to the end on which the wedge surface is located abutting against said top wall.

5. The assembly of claim 4 wherein said inclined surface means comprises a pair of inclined surfaces which are spaced from each other, said wedge assembly having a pair of wedge surfaces which matingly engage said inclined surfaces.

6. The assembly of claim 1 and further including spring means for resiliently urging the wheel unit away from the main frame.

* * * * *